United States Patent [19]

Dätwyler et al.

[11] 4,149,159

[45] Apr. 10, 1979

[54] FIRE DETECTION SYSTEM

[75] Inventors: Fritz Dätwyler; Ernst Huber, both of Männedorf, Switzerland

[73] Assignee: Cerberus AG, Männedorf, Switzerland

[21] Appl. No.: 850,789

[22] Filed: Nov. 11, 1977

[30] Foreign Application Priority Data

Nov. 16, 1976 [CH] Switzerland ..... 14378/76

[51] Int. Cl.[2] ..... G08B 17/06; G08B 17/10

[52] U.S. Cl. ..... 340/587; 340/522; 340/584; 340/628

[58] Field of Search ..... 340/587, 584, 522, 508, 340/589, 593, 595, 628; 169/23, 61, 60, 56

[56] References Cited

U.S. PATENT DOCUMENTS 3,541,539 11/1970 Trumble ..... 340/522

3,922,656 11/1975 Horvath et al. ..... 340/522

4,005,754 2/1977 Linden et al. ..... 340/628

*Primary Examiner*—Glen R. Swann, III

*Attorney, Agent, or Firm*—Flynn & Frishauf

[57] ABSTRACT

In a fire detection system, detectors of different sensitivities are arranged in pairs and the pairs of fire detectors are positioned at regular intervals along an elongated protection area, whereby detectors of one sensitivity alternating with detectors of the other sensitivity are connected via two line systems to a signal center which emits an alarm signal when an alarm signal is simultaneously received via both line systems. In use, for example in a vehicle tunnel, a more uniform response sensitivity is obtained along the protection area, accompanied by a decrease in the necessary number of fire detectors and a reduced tendency to false alarms.

8 Claims, 3 Drawing Figures

PRIOR ART

FIRE DETECTION SYSTEM

BACKGROUND OF THE INVENTION

The present invention relates to fire detection apparatus for an extensive protection area, with a plurality of fire detectors connected in pairs to a fire detection centre by means of at least two line systems, whereby the fire detection centre is set up in such a way that it signals a fire alarm on simultaneously receiving via both line systems a signal released by at least one fire detector in each system.

The fire detectors can be of many types which react to particular fire phenomena or to a predetermined temperature maximum or differential. The associated fire detection centre can have two known switching or signal equipments interconnected in an AND circuit and which react to the alarm current of a fire detector.

Various types of fire detectors are known for reacting to certain fire phenomena. These include detectors which react to a predetermined maximum temperature and detectors which react to a temperature differential. The fire detection centre associated with such detectors can have two known switching or signal units interconnected in an AND circuit and which react to the alarm current of a fire detector.

However, pneumatic fire detection systems have the disadvantage that they are triggered even if small leaks occur, such as from slow corrosion. As the system cannot be monitored, it is impossible to automatically detect such defects. In addition, the discovery and location of the faulty point is extremely difficult and correspondingly costly. When such pneumatic fire detection systems are used in a vehicle tunnel, for example, this problem is exacerbated by stresses resulting from pressure waves and vibrations caused by the vehicles passing through and by local and time-based temperature fluctuations, together with rock movements which can lead to the fracture of pipe lines, rendering the system inoperative or causing false alarms.

It is known that these disadvantages can be partly obviated by electrical fire detection systems in which several fire detectors are distributed individually over the protection area and are connected in groups to a signal station by means of common lines. Such fire detectors can be of any desired type, e.g. ionization smoke detectors, stray detectors, combustion gas sensors, flame detectors or temperature detectors operating with bimetallic strips, aneroid diaphragms, or temperature-sensitive semiconductors which emit an alarm signal either when the corresponding fire phenomenon has reached a certain intensity or when it reveals a rapid time-based change. However, it is a disadvantage of the various types of fire detectors that they have a tendency to give a false alarm signal without there being any cause for an alarm. This can either be caused by the actual characteristics of the fire detector as a result of ageing, dust contamination, etc., or can result from external influences which may only simulate a fire.

However, particularly in vehicle tunnels false fire alarms cannot be tolerated, due to the measures which are initiated whenever there is an alarm, e.g. total traffic stoppage, summoning of police and fire brigade, etc. Therefore, attempts have been made to prevent the tendency towards false alarms of such electrical fire detection systems through the use of two parallel line systems. FIG. 1 shows such a fire detection arrangement in which a plurality of fire detectors A1, A2 . . .

A6 are arranged at regular intervals along a tunnel T. The individual detectors are alternately connected by means of a line L1 or a second line L2 to a fire detection centre C which releases an alarm signal on simultaneously receiving an alarm signal from a fire detector connected to each of the two lines L1 and L2. Use is thereby made of the fact that for example in the case of a fire between fire detectors A1 and A2, both of the detectors are activated. The giving of false alarms can be largely eliminated by this known scheme, which is called two-loop dependence. However, a disadvantage of this method is the varying sensitivity of the system as a function of the fire location point. If, for example, the centre of the fire is located directly below a detector A2, little influence is exerted on adjacent fire detectors A1 and A3, whereas detector A2 is influenced to a very great extent. However, an alarm signal can only be released if a sufficiently great influence is exerted on adjacent fire detectors A1 or A3. However, in the case where a fire centre is located between two fire detectors, e.g. between A1 and A2, an alarm signal is released much earlier, because then both detectors A1 and A2 are sufficiently influenced by the fire much earlier.

In order to increase the security against false alarms, it has already been proposed to arrange two sensors at each measurement point which react to a different fire phenomenon, e.g. simultaneously to smoke and temperature rise or to smoke and combustion gases. In the example shown in FIG. 2, at a first location there are provided in each case a detector of the first type A1 and a detector of the second type B1, with corresponding detectors A2 and B2, etc., at following monitoring locations, whereby the detectors of the first type A1, A2, etc., are connected via a line system L1 to the fire detection centre C, and the detectors of the second type B1, B2, etc., are connected thereto via a second line system L2. Centre C releases a signal only on receiving a signal via both lines from at least one of the fire detectors, i.e. if several fire phenomena occur simultaneously. This permits a relatively reliable differentiation between a genuine fire and other disturbance variables, but does not solve the problem of differing sensitivity depending on the location of the centre of the fire relative to the individual pairs of fire detectors. In such systems, it was therefore necessary to use a maximum number of fire detectors in order to obtain an adequate sensitivity with minimum fluctuations over the entire length of the tunnel.

It would be desireable, then, to provide an electrical fire detection system having a high operational reliability and low tendency to false alarm, while using a reduced number of fire detectors. At the same time, the response sensitivity should have optimum constancy over the entire protection area, independently of the distance of the centre of a fire from the fire detector.

SUMMARY OF THE INVENTION

According to the present invention, in each case two fire detectors of differing sensitivity are arranged in pairs, the pairs of fire detectors being placed along the protection area, interconnected via the two line systems, and also connected to the fire detection centre. In each of the two line systems, then, the fire detectors of a first sensitivity are in each case alternately connected with the fire detectors of the other sensitivity of the following and/or preceding pair of detectors.

DETAILED DESCRIPTION OF THE PREFERRED EMBODIMENTS

Figure 1:
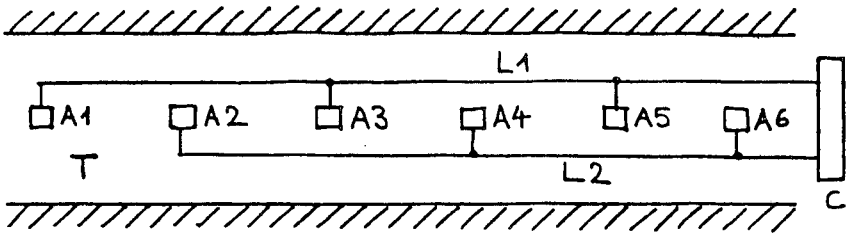
Fig.1 PRIOR ART
FIG. 1 is a schematic illustration of a prior art fire detection system in which a plurality of fire detectors are arranged at regular intervals along a tunnel.
Figure 2:
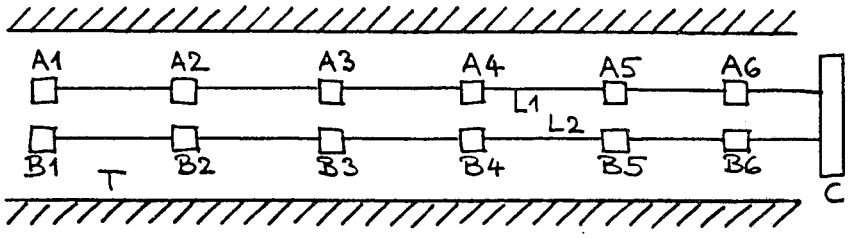
FIG. 2 is a schematic illustration of another prior art fire detection system, in which a plurality of fire detectors of two types, each type reacting to a different fire phenomenon, are connected along two different lines along a tunnel to a fire detection center, all the detectors of one type being connected to the same line.
Figure 3:
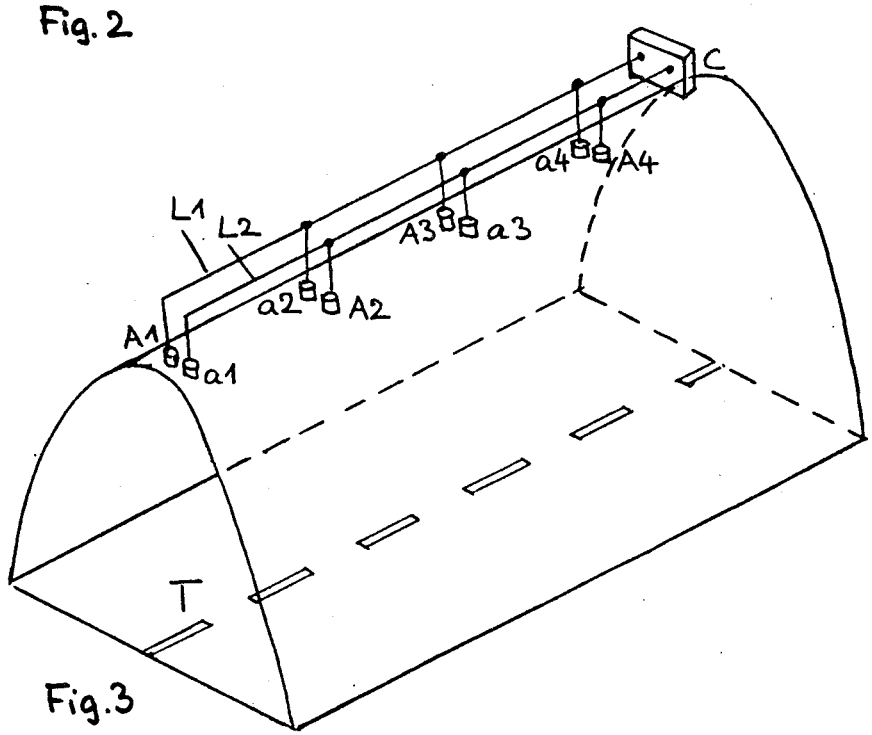
FIG. 3 is a schematic perspective illustration of a tunnel section in which there is a fire detection system in accordance with a preferred embodiment of the present invention.

The invention is described relative to the embodiment shown in FIG. 3, whereby two different types of fire detectors A1 and a1 as well as A2 and a2 are arranged in pairs at regular intervals over the roof of a tunnel T. The individual pairs of fire detectors can be detectors which react differently to the individual fire phenomena, e.g. an ionization smoke detector can in each case be combined with a flame or temperature detector. However, they can also be fire detectors which react to the same fire phenomenon, but have a different sensitivity, i.e. having a different detection or sensitivity threshold for the same fire phenomenon. For example, fire detectors A1, A2, etc., can be constructed as known temperature rise detectors, which give an alarm signal e.g. in the case of a temperature speed of 10° C./min, while the other detectors a1, a2, etc., are constructed as similar temperature detectors which operate at a temperature rise speed of 5° C./min. Both fire detectors having differing sensitivities and belonging to the same pair can also be combined to form a joint fire detection unit, whereby either two different sensors are provided or the evaluation circuit has two threshold values connected to different outputs.

According to the invention, the individual fire detectors are connected to two line systems L1 and L2 which lead to signal centre C in such a way that in each case a fire detector of one sensitivity is joined to a fire detector of the other sensitivity of the following and/or preceding pair of detectors in alternating manner on one line, e.g. L1. In the represented embodiment, detectors A1, a2, A3, a4, etc., are for example connected to line L1 and detectors a1, A2, a3, A4, etc., to line L2. Signal centre C is set up in such a way as to emit a main alarm signal when a signal is simultaneously received from at least one of the connected fire detectors by means of both lines L1 and L2. This main alarm signal initiates all the necessary fire fighting and traffic safety measures. In addition, the fire alarm centre can be set up to give an early warning signal if a signal is received from a fire detector via only one line. This would bring about a standby alert condition for an alarm without sounding the actual alarm to protective measures, thus allowing for, for example, the sending out of a patrol to establish the cause of the early warning.

Tests of a fire alarm arrangement such as that described above have shown it particularly advantageous for use in vehicle tunnels. The fire detectors for the tests were temperature-differential detectors, such a for example detectors identified as CERBERUS TFM type and marketed at least in 1977 at least in Switzerland by Cerberus AG, CH-8708 Männedorf, Switzerland, and having a temperature-sensitive element. For each pair of detectors, one was set to a threshold value of the temperature rise rate of 10 degrees Celsius per minute and the other to a rate of 5 degrees Celsius per minute. The tests showed that with simulations of truck and trailer combinations having exhaust emission at the top of the vehicle, only the more sensitive of the fire detectors was activated. In no case was the less sensitive detector activated. However, when a genuine fire was located directly below a pair of fire detectors, the temperature rise was sufficiently rapid for both fire detectors, e.g. detectors A2 and a2, to be activated simultaneously. In the case of a fire centre precisely half way between two pairs of the fire detectors, i.e. between A1–a1 and A2–a2, only the more sensitive detectors of the two pairs were activated. However, as they were connected to different lines, i.e. a1 to line L2 and a2 to line L1, a fire alarm was still triggered by the centre. Through the alternate connection of the more sensitive fire detectors to different lines, there was no significant drop in sensitivity between two detector locations. As a result, the monitoring points could be placed further apart than with the prior art systems without causing larger sensitivity fluctuations along the length of the tunnel, thereby considerably cutting costs. The advantage of two-loop dependence, i.e. the security against false alarms, is thereby fully maintained.

The use of the above-described fire detection arrangements according to the invention is particularly advantageous in the case of extensive protection areas in which particularly high demands are made on reliability and operational security of the arrangements, e.g. if the fire detection arrangement controls an extinguishing system or actuates other fire controls. Such protection areas can be, for example, vehicle tunnels, such as road tunnels, railway tunnels or subway tunnels, as well as extensive elongated areas, such as mine shafts or long passageways, e.g. in fortifications.

We claim:

1. A fire detection system of the type for monitoring an extensive area by means of a plurality of fire detector pairs connected to a fire detection center by means of at least two parallel lines, the individual detectors of each pair being connected to different lines, with the center signalling an alarm only if it receives signals simultaneously from both said parallel lines that at least one detector connected to each of said parallel lines has been activated, the improvement therein comprising that each of said pairs of detectors includes a first detector having a first sensitivity and a second detector having a substantially different, second sensitivity, said detectors being connected to said parallel lines so that along each of said parallel lines there are connected alternately detectors of said first sensitivity and detectors of said second sensitivity.

2. The system of claim 1 and wherein said first detectors are sensitive to a different fire phenomenon than are said second detectors.

3. The system of claim 1, wherein said first and second detectors are sensitive to the same fire phenomenon, but have different sensitivity thresholds to it.

4. The fire detection system of claim 3, wherein said first and second fire detectors are provided with a temperature-sensitive element.

5. The fire detection system of claim 4, wherein said fire detectors are constructed as temperature-differential detectors and emit a signal when the rate of temperature rise exceeds a predetermined threshold.

6. The fire detection system of claim 1, wherein said fire detectors react to smoke, combustion gases or flames.

7. The fire detection system of claim 1, wherein said first and second fire detectors of one of said pairs are arranged in the immediate vicinity of one another.

8. The fire detection system of claim 1, wherein said pairs of fire detectors are arranged at regular intervals along the protection area.

* * * * *